US006896433B1

(12) United States Patent
Zhang et al.

(10) Patent No.: US 6,896,433 B1
(45) Date of Patent: May 24, 2005

(54) COSMETICIZING PEN

(76) Inventors: Jun Zhang, 2F., No. 8, Jhuangjing St., Sijhih City, Taipei County 221 (TW); Chen-Ling Liu, 2F., No. 8, Jhuangjing St., Sijhih City, Taipei County 221 (TW)

( * ) Notice: Subject to any disclaimer, the term of this patent is extended or adjusted under 35 U.S.C. 154(b) by 0 days.

(21) Appl. No.: 10/862,749

(22) Filed: Jun. 7, 2004

(51) Int. Cl.[7] ..... B05C 1/00; A47L 1/08

(52) U.S. Cl. ..... 401/17; 401/25; 401/26

(58) Field of Search ..... 401/16, 17, 18, 401/23, 25, 26, 27; 132/317

(56) References Cited

U.S. PATENT DOCUMENTS 5,832,942 A * 11/1998 Gutberlet ..... 132/317
6,773,184 B2 * 8/2004 An ..... 401/31

* cited by examiner

*Primary Examiner*—David J. Walczak
(74) *Attorney, Agent, or Firm*—Alan D. Kamrath; Nikolai & Mersereau, P.A.

(57) ABSTRACT

A cosmeticizing pen includes a sleeve and a guider partially received in the sleeve. A first cylinder and a second cylinder respectively longitudinally mounted to two opposite ends of the guider for containing two different cosmetics. A first head and a second head are respectively mounted to a free end of each of the first cylinder and the second cylinder. A first cap and a second cap are respectively mounted to the first head and the second head for protect the first head and the second head after use.

5 Claims, 7 Drawing Sheets

COSMETICIZING PEN

BACKGROUND OF THE INVENTION

1. Field of the Invention

The present invention relates to a cosmeticizing pen, and more particularly to a cosmeticizing pen that contains two different cosmetics in two opposite ends thereof.

2. Description of Related Art

A conventional cosmeticizing pen in accordance with the prior art shown in FIGS. 6 and 7 comprises a shank (70) having a through hole (71) longitudinally centrally defined in the shank (70) for containing the cosmetic. The through hole (71) has a polygonal section (72) formed on a middle portion of the hollow shank (70) and an annular groove (73) defined in an inner periphery of the through hole (71) near a rear end of the hollow shank (70). A guider (74) is longitudinally attached to a front end of the hollow shank (70) for guiding the cosmetic squeezed out of the shank (70). A cap (75) covers the guider (74) and is attached to the front end of the hollow shank (70) for protecting the guider (74) after use.

An actuated rod (76) is received in the hollow shank (70) and a having a threaded outer periphery (77) formed thereon. An enlarged head (760) is formed on a front end of the actuated rod (76) and received in the polygonal section (72) in the shank (70). The enlarged head (760) has a shape corresponding to that of the polygonal section (72) of the through hole (71) in the shank (70) such that the actuated rod (76) cannot be rotated when being received in the polygonal section (72) in the shank (70). A sealant (78) is mounted around the enlarged head (760) and abuts the inner periphery of the polygonal section (72) to form an airtight effect between the enlarged head (760) and the inner periphery of the polygonal section (72).

A rotor (80) is rotatably mounted to the rear end of the shank (70). The rotor (80) includes a protrusion (81) longitudinally extending therefrom and rotatably received in the through hole (71) in the shank (70). The protrusion (81) has a threaded hole (82) centally defined therein and the actuated rod (76) is partially screwed into the threaded hole (82) due to the threaded outer periphery (77) thereof. A flange (83) outwardly radially extends from the protrusion (81) and rotatably received in the annular groove (73) when the rotor (80) is longitudinally mounted to the rear end of the shank (70).

When operating, the cap (75) is detached from the front end of the shank (70). The rotor (80) is rotated and the actuated rod (76) is moved toward the front end of the shank (70) for squeezing the cosmetic from the shank (70) to the guider (74) for user to dress.

However, the conventional cosmeticizing pen contains only one cosmetic. The user needs to prepare multiple conventional cosmeticizing pens for containing various cosmetics. It is inconvenient. Furthermore, the multiple conventional cosmeticizing pens will occupy most of the room in the handbag.

The present invention has arisen to mitigate and/or obviate the disadvantages of the conventional cosmeticizing pen.

SUMMARY OF THE INVENTION

The main objective of the present invention is to provide an improved cosmeticizing pen that contains two different cosmetics in two opposite ends thereof.

To achieve the objective, the cosmeticizing pen in accordance with the present invention comprises a sleeve and a guider partially received in the sleeve. A first cylinder and a second cylinder respectively longitudinally mounted to two opposite ends of the guider for containing two different cosmetics. A first head and a second head are respectively mounted to a free end of each of the first cylinder and the second cylinder. A first cap and a second cap are respectively mounted to the first head and the second head for protect the first head and the second head after use.

Further benefits and advantages of the present invention will become apparent after a careful reading of the detailed description with appropriate reference to the accompanying drawings.

DETAILED DESCRIPTION OF THE INVENTION

Figure 1:
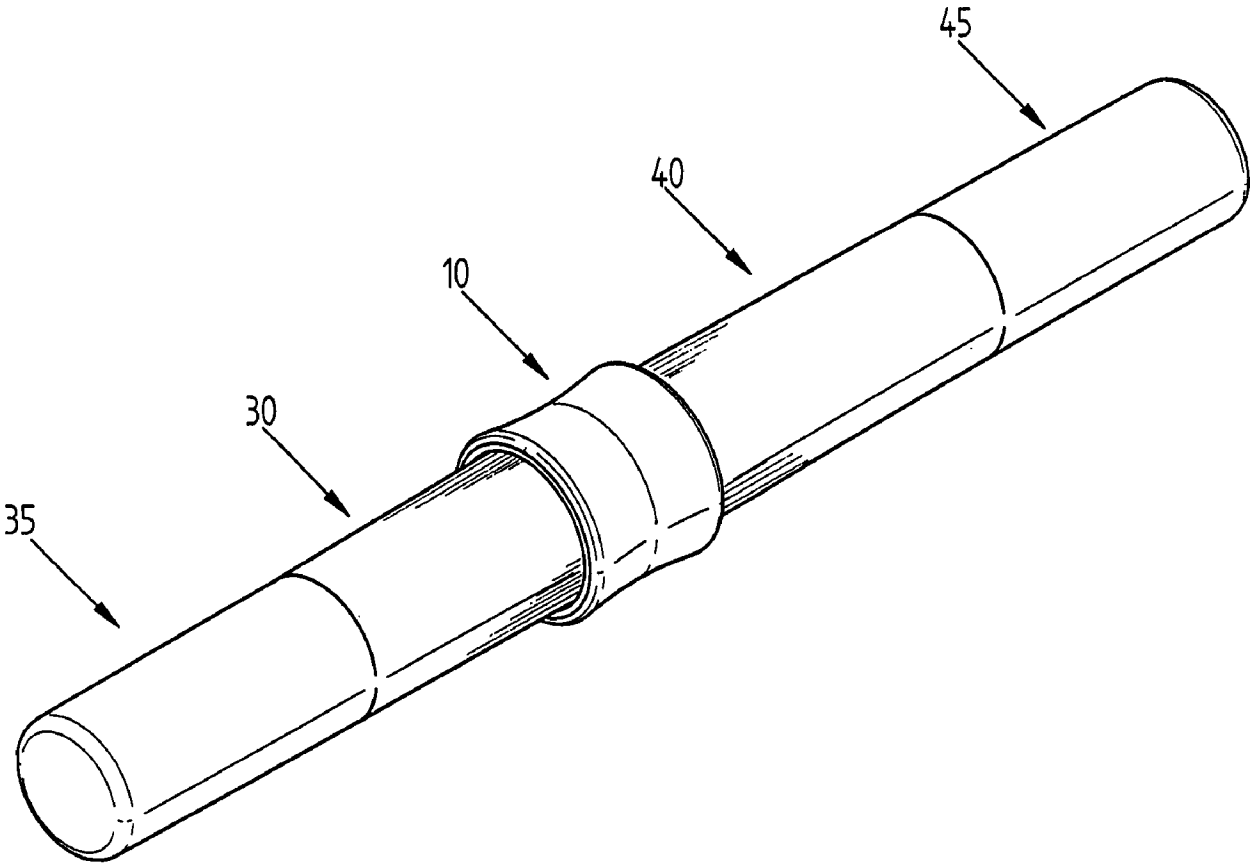
FIG. 1 is a perspective view of a cosmeticizing pen in accordance with the present invention.
Figure 2:
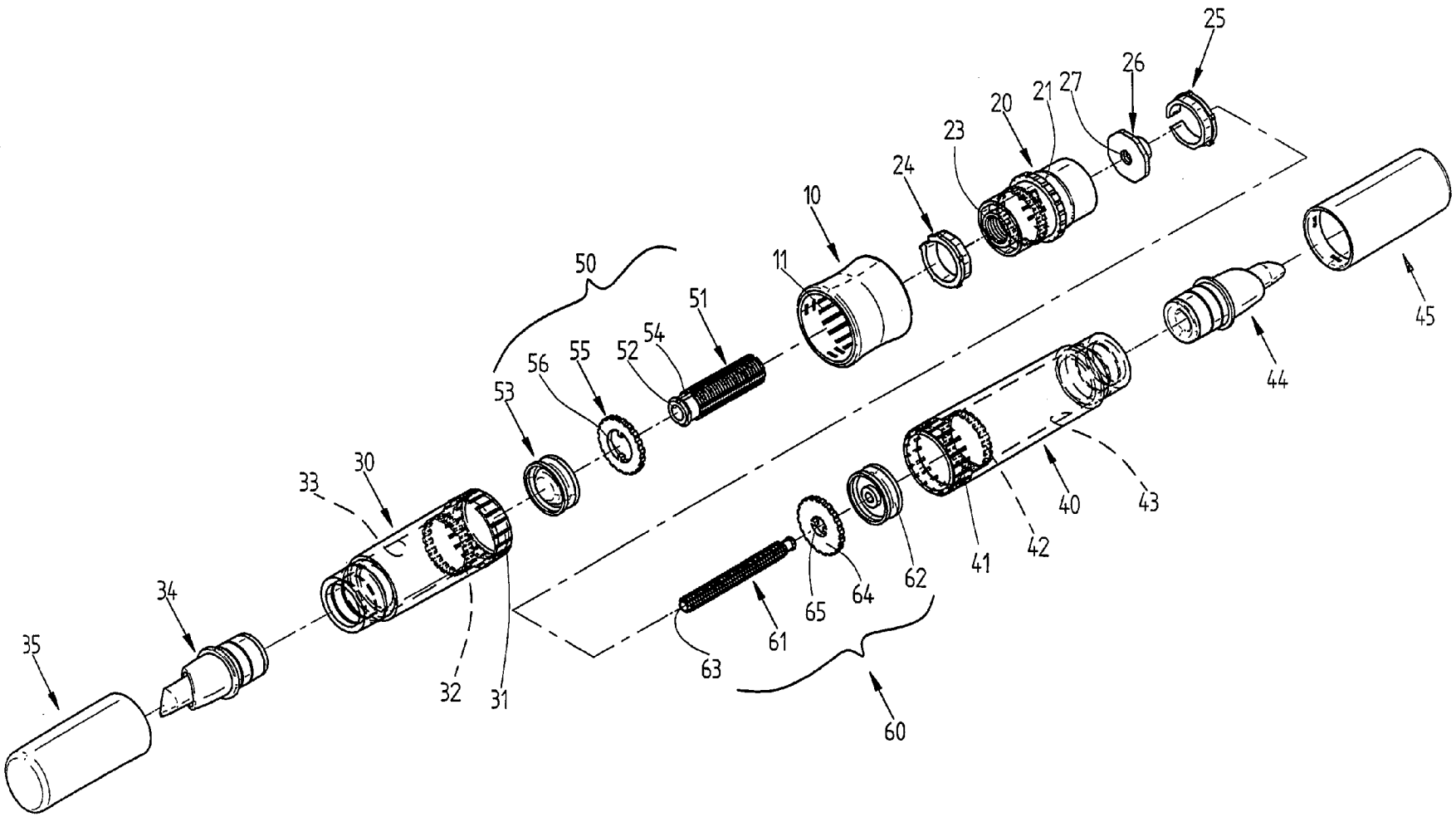
FIG. 2 is an exploded perspective view of the cosmeticizing pen in FIG. 1.
Figure 3:
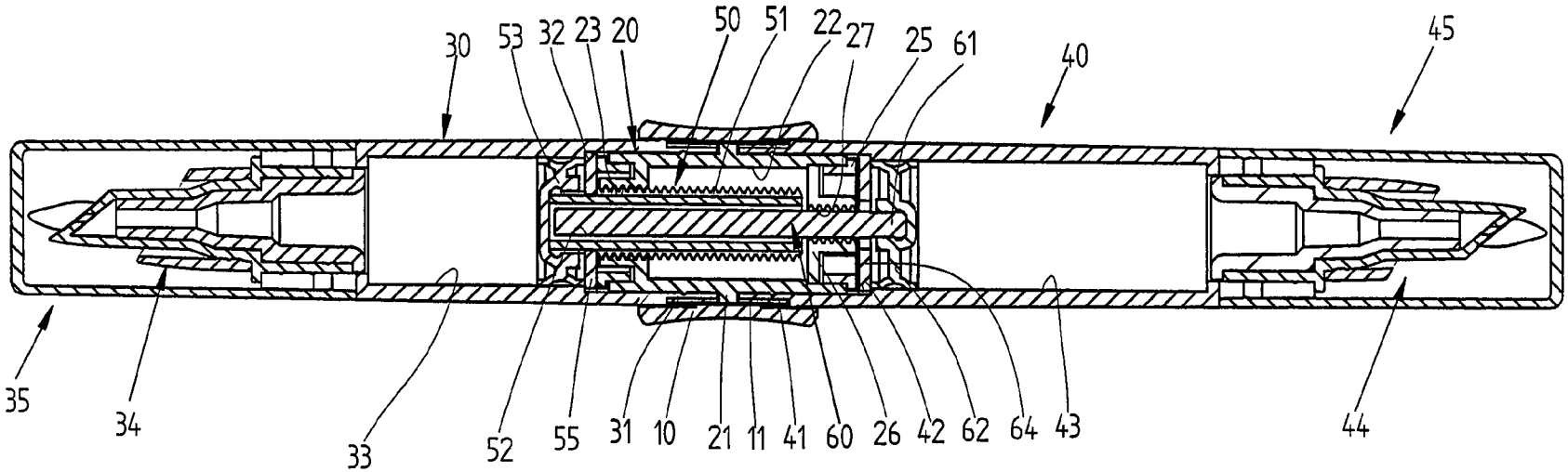
FIG. 3 is a side cross-sectional view of the cosmeticizing pen in FIG. 1.

Referring to the drawings and initially to FIGS. 1–3, a cosmeticizing pen in accordance with the present invention comprises a sleeve (10) including a first series of teeth (11) formed on an inner periphery of the sleeve (10).

A guider (20) is partially rotatably received in a first end of the sleeve (10). The guider (20) includes a second series of teeth (21) formed on an outer periphery thereof and engaged to the first series of teeth (11) of the sleeve (10). A through hole (22) is longitudinally centrally defined in the guider (20) and a threaded portion (23) is formed on one end of the through hole (22) relative to the sleeve (10). A first buckle (24) is centrally securely disposed on a first end of the guider (20). A nut (26) is centrally mounted to a second end of the guider (20) and a second buckle (25) is centrally securely disposed on the second end of the guider (20) to hold the nut (26) in place. A threaded hole (27) is centrally longitudinally defined in the nut (26) and extends through the nut (26).

A first cylinder (30) and a second cylinder (40) each has a first end rotatably received in the sleeve (10) and is selectively engaged to the first series of teeth (11). The first end and the second end of the guider (20) are respectively rotatably received in the first end of the first cylinder (30) and the first end of the second cylinder (40). The first cylinder (30) has a third series of teeth (31) formed on the outer periphery of the first end thereof, and the second cylinder (40) has a fourth series of teeth (41) formed on an outer periphery of the first end thereof. A total distance of the third series of teeth (31) of the first cylinder (30) and the second series of teeth (21) is longer than that of the first series of teeth (11) such that third series of teeth (31) and the fourth series of teeth (41) can be selectively engaged to the first series of teeth (11) of the sleeve (10). A first chamber (33) and a second chamber (43) are respectively longitudinally defined in the first cylinder (30) and the second chamber (40). A fifth series of teeth (32) and a sixth series of teeth (42) are respectively formed on an inner periphery of each of the first chamber (33) and the second chamber (43).

A first head (34) and a second head (44) are respectively mounted to a second end of each of the first cylinder (30) and the second cylinder (40). A first cap (35) and a second cap (45) are respectively detachably mounted to the first head (34) and the second head (44) for protecting the first head (34) and the second head (44) after use.

A first drive set (50) is mounted in the first cylinder (30) and extends into the guider (20). The first drive set (50) includes a tube (51) with a threaded outer periphery and a through hole (52) longitudinally defined in the tube (51). The tube (51) has a first end screwed into the threaded portion (23) of the through hole (22) and a second end having a first piston (53) pivotally mounted thereon. The first piston (53) is slidably received in the first chamber (33) for squeezing the cosmetic from the first chamber (33) to the first head (34). Two first grooves (54) are longitudinally defined in the outer periphery of the tube (51) and diametrically correspond to each other. A position ring (55) is sleeved on the tube (51) and engaged to the fifth series of teeth (32) of the first cylinder (30), and abuts against the first buckle (24). The position ring (55) has two protrusions (56) inwardly extending to be received in the two first grooves (54) to prevent the tube (51) from being rotated with the guider (20).

A second drive set (60) is mounted in the second cylinder (40) and extend into the tube (51). The second drive set (60) includes a threaded rod (61) having a first end screwed through the threaded hole (27) in the nut (26) and partially received in the through hole (52) in the tube (51), and a second end having a second piston (62) pivotally mounted thereon. The second piston (62) is slidably received in the second chamber (43) for squeezing the cosmetic from the second chamber (43) to the second head (44). Two second grooves (63) are longitudinally defined in an outer periphery of the threaded rod (61) and diametrically correspond to each other. A second position ring (64) is sleeved on the threaded rod (61), engaged to the sixth series of teeth (42) of the second cylinder (40) and abuts the second buckle (25). The second position ring (64) has two protrusions (65) inwardly extending therefrom and movably received in the two second grooves (63) to prevent the threaded rod (61) from being rotated with the nut (26).

Figure 4:
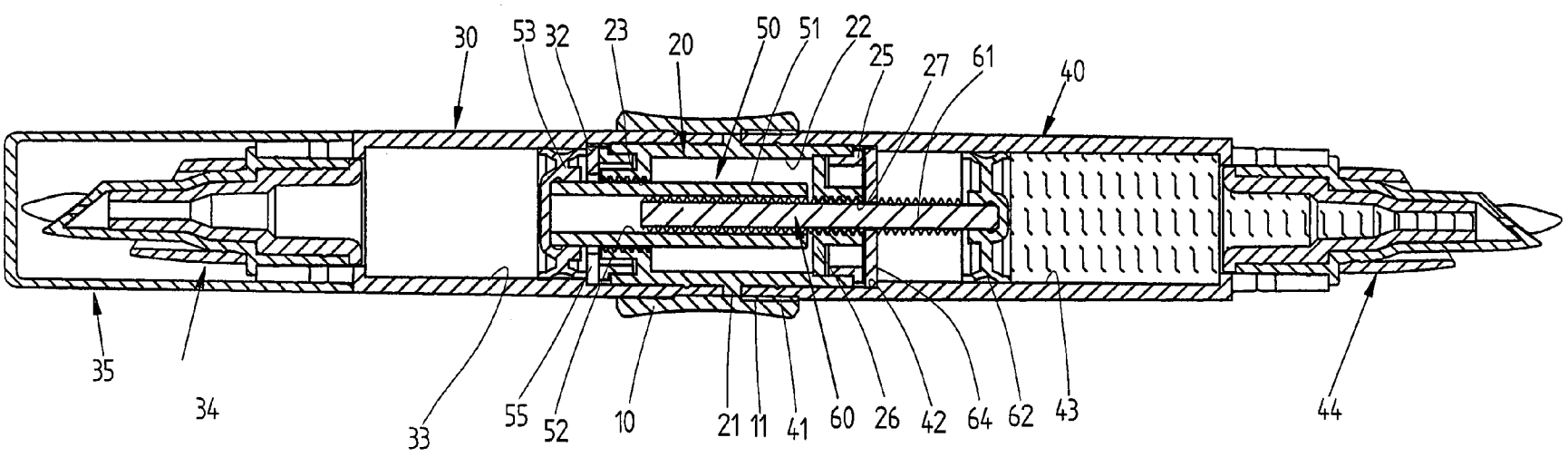
FIG. 4 is an operational view in cross-section of the cosmeticizing pen in FIG. 1.
Figure 5:
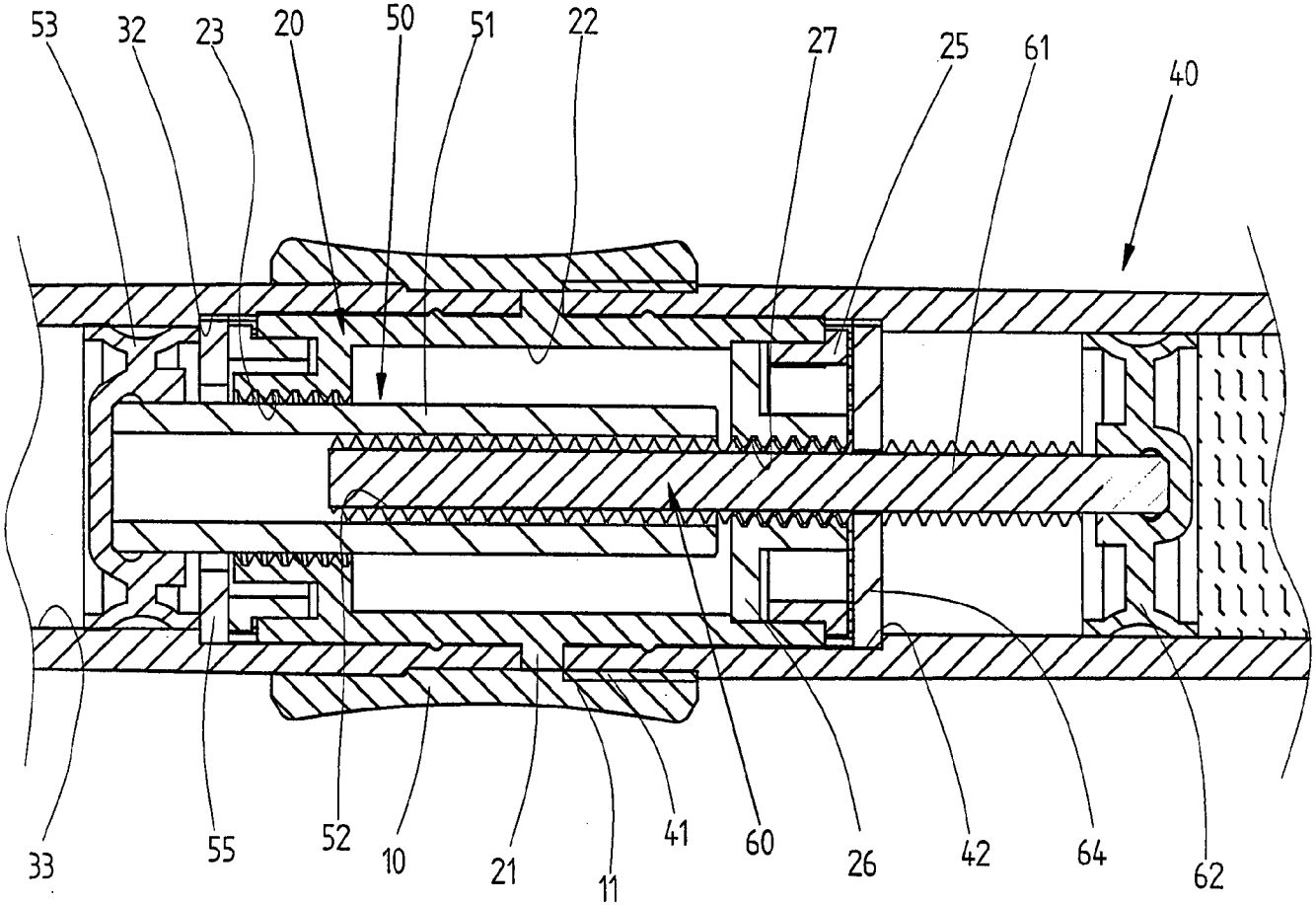
FIG. 5 is a partially enlarged view of FIG. 4.
Figure 6:
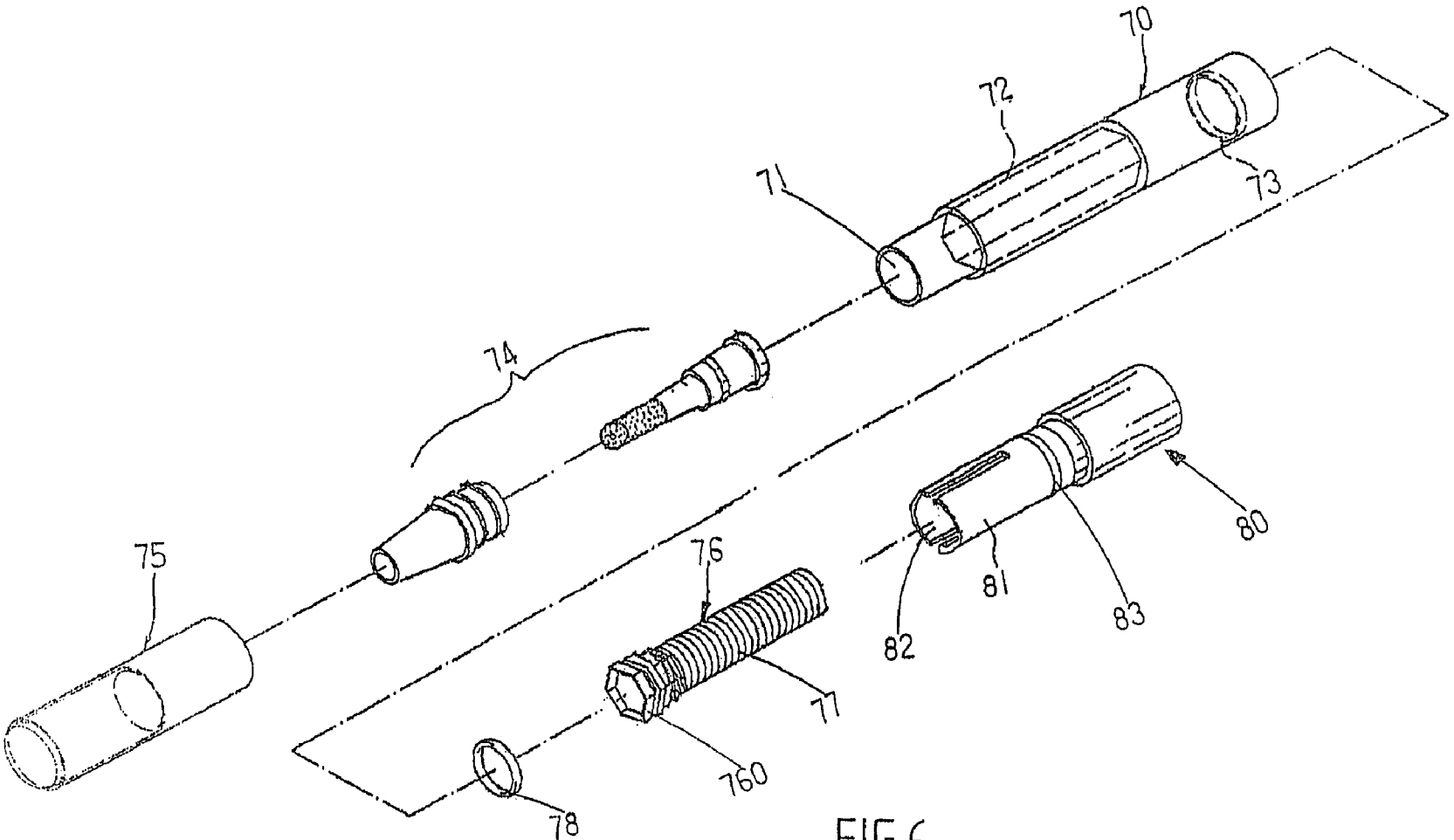
FIG.6 PRIOR ART
FIG. 6 is an exploded perspective view of a conventional cosmeticizing pen in accordance with the prior art.
Figure 7:
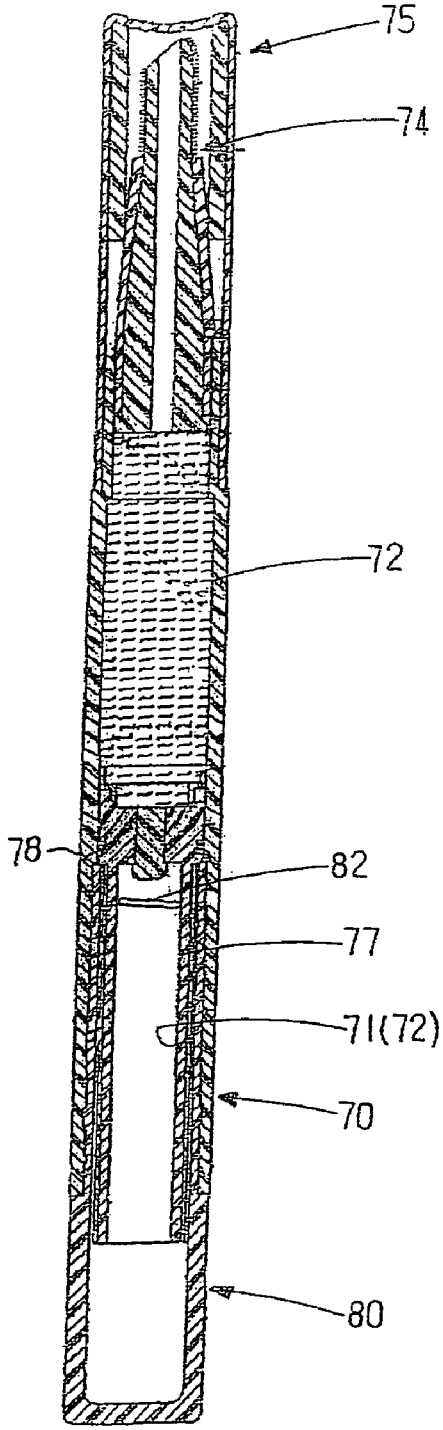
FIG.7 PRIOR ART
FIG. 7 is a cross-sectional view of the conventional cosmeticizing pen in accordance with the prior art.

With reference to FIGS. 3–5, when using the second head (44) for cosmeticizing, the sleeve (10) is moved toward the first cylinder (30) to make the first series of teeth (11) of the sleeve (10) disengaged from the fourth series of teeth (41) of the second cylinder (40) an engaged to the third series of teeth (31) of the first cylinder (30), thereby the first cylinder (30), the guider (20) and the sleeve (10) is engaged to one another and cannot be rotated relative to one another. The second cylinder (40) is rotated relative to the sleeve (10) and second position ring (64) of the second drive set (60) is operated with the second cylinder (40) to drive the threaded rod (61) to be rotated. However, the nut (26) is positioned on the guider (20) such that the threaded rod (61) is longitudinally moved relative the nut (26) toward the second head (44) and the piston (62) is moved toward the second head (44) for squeezing the cosmetic to the second head (44). The second piston (62) is moved back toward the sleeve (10) when the second cylinder (40) is reversely rotated. The operate method for using the first head (34) is contrary to that of the second head (44).

Although the invention has been explained in relation to its preferred embodiment, it is to be understood that many other possible modifications and variations can be made without departing from the spirit and scope of the invention as hereinafter claimed.

What is claimed is:

1. A cosmeticizing pen comprising:

a sleeve having a first series of teeth formed on an inner periphery thereof;

a guider partially rotatably received in the sleeve, the guider having a second series of teeth formed on an outer periphery thereof and engaged to the first series of teeth of the sleeve, a through hole longitudinally centrally defined in the guider and having a threaded portion formed on a first end of the guider through hole relative to the sleeve and a threaded hole defined in a second end of the guider, the threaded hole having a diameter smaller than that of the threaded portion of the through hole;

a first cylinder and second cylinder each having a first end respectively pivotally receiving the first end and the second end of the guider, a first chamber and a second chamber respectively longitudinally centrally defined in the first cylinder and the second cylinder for containing cosmetics;

a first head and a second head respectively longitudinally mounted to a second end of each of the first cylinder and the second cylinder;

a first cap and second cap respectively detachably mounted to the first head and the second head for protecting the first head and the second head after use;

a first drive set partially received in the first cylinder and extending into the guider, the first drive set including a tube with a threaded outer periphery moved along an axis thereof, a through hole longitudinally centrally defined in the tube, the tube having a first end screwed into the threaded portion of the through hole in the guider and received in the guider, the tube including a second end having a piston pivotally mounted thereon, the piston slidably received in the first chamber for squeezing the cosmetic form the first chamber to the first head, the tube having two first grooves defined in the outer periphery thereof and diametrically corresponding to each other, a first position ring sleeved on the tube and engaged to an inner periphery of the first cylinder, the first position ring having two protrusions inwardly extending therefrom and movably received in the two first groove in the tube; and a second drive set partially received in the second cylinder and extending into the guider, the second drive set including a threaded rod moved along an axis thereof, the threaded rod having a first end screwed into the threaded hole in the guider and extending into the through hole in the tube, the threaded rod including a second end having a piston pivotally mounted thereon and slidably received in the second chamber in the second cylinder for squeezing the cosmetic from the second chamber to the second head, two second grooves longitudinally defined in an outer periphery of the threaded rod and diametrically corresponding to each other, a second position ring sleeved on the threaded rod and engaged to an inner periphery of the second chamber, the second position ring having two protrusion inwardly extending therefrom and movably received in the two second grooves in the threaded rod.

2. The cosmeticizing pen as claimed in claim 1, wherein the guider comprises a first buckle and a second buckle respectively centrally and securely disposed on the first end and the second end of the guider, the first position ring abutting against the first buckle and the second position ring abutting the second buckle.

3. The cosmeticizing pen as claimed in claim 2, wherein the guider comprises a nut mounted between the second end and the second buckle, and the threaded hole in the guider is centrally defined in the nut.

4. The cosmeticizing pen as claimed in claim 1, wherein the first cylinder comprises a third series of teeth formed on an outer periphery of the first end thereof and engaged to the first series of teeth, and the second cylinder comprises a fourth series of teeth formed on an outer periphery of the first end thereof and engaged to the first series of teeth, a total distance of the third series of teeth of the first cylinder and the second series of teeth is longer than that of the first series of teeth such that the third series of teeth and the fourth series of teeth are selectively engaged to the first series of teeth of the sleeve.

5. The cosmeticizing pen as claimed I claim 1, wherein the first cylinder has a fifth series of teeth formed on an inner periphery of the first cylinder and the first position ring engaged to the fifth series of teeth, and the second cylinder has a sixth series of teeth formed on an inner periphery of the second cylinder and the second position ring engaged to the sixth series of teeth.

* * * * *